US012752974B2

(12) United States Patent
Xu

(10) Patent No.: US 12,752,974 B2
(45) Date of Patent: Oct. 6, 2026

(54) LOCKING MEMBER AND BOX THEREOF

(71) Applicant: A&A INTELLIGENT (SHENZHEN) CO., LTD., Shenzhen (CN)

(72) Inventor: Bin Xu, Shenzhen (CN)

(73) Assignee: A&A INTELLIGENT (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 19/183,314

(22) Filed: Apr. 18, 2025

(65) Prior Publication Data

US 2026/0159284 A1 Jun. 11, 2026

Related U.S. Application Data

(63) Continuation-in-part of application No. 18/434,740, filed on Feb. 6, 2024, now Pat. No. 12,384,605.

(30) Foreign Application Priority Data

Jun. 20, 2023 (CN) ..... 202321593475.7
Mar. 18, 2025 (CN) ..... 202520482859.4

(51) Int. Cl.
*B65D 43/22* (2006.01)
*A63F 3/00* (2006.01)
*A63F 3/02* (2006.01)

(52) U.S. Cl.
CPC ..... *B65D 43/22* (2013.01); *A63F 3/00895* (2013.01); *A63F 2003/00962* (2013.01); *A63F 3/02* (2013.01); *B65D 2251/1016* (2013.01)

(58) Field of Classification Search
CPC ..... B65D 2251/1016; B65D 43/22; B65D 2251/1058; B65D 51/00; E05B 73/0005; E05C 17/50; A63F 3/00895; A63F 3/02; A63F 2003/00962
USPC ..... 292/246; 206/315.1, 315
See application file for complete search history.

(56) References Cited

U.S. PATENT DOCUMENTS 174,958 A * 3/1876 Homrighausen ..... A63F 3/0023 273/285
1,184,439 A * 5/1916 Giles ..... E05C 17/50 292/DIG. 20
2,829,912 A * 4/1958 Koch ..... E05C 19/14 70/73
3,030,137 A * 4/1962 Thomkinson ..... E05C 19/14 292/113

(Continued)

*Primary Examiner* — Ernesto A Grano
(74) *Attorney, Agent, or Firm* — Hemisphere Law, PLLC

(57) ABSTRACT

The present disclosure provides a locking member and a box thereof, the locking member is easily configured to insert a first base into a second base through a first protrusion and a second protrusion thereof, and use a fastener to simultaneously receive and lock the first base and the second base in a locking space of the fastener for obtaining a lock thereof. When the fastener is subjected to a force to rotate away from the second base, the second base detaches from the first base for achieving an unlock thereof. When the first base and the second base are respectively installed near two end surfaces of the box that need to be locked, after the box is opened, the first and second protrusions are configured to be as support feet for the box, thereby ensuring flatness of splicing surfaces of the box after the box being folded. The locking member of the present disclosure is simple and easy to be operated, and the box is beautiful and saving costs.

20 Claims, 3 Drawing Sheets

(56) References Cited

U.S. PATENT DOCUMENTS 4,540,206 A * 9/1985 Frame ..... E05C 19/14 292/DIG. 60
4,545,768 A * 10/1985 Hinnen ..... G09B 19/12 434/304
4,705,308 A * 11/1987 Bisbing ..... E05C 19/14 292/108
4,801,165 A * 1/1989 Pyle ..... E05C 19/14 292/249
4,811,954 A * 3/1989 Hemmann ..... A63F 3/0023 273/284
4,828,502 A * 5/1989 Leahy ..... B43L 1/06 434/416
5,145,185 A * 9/1992 Yu ..... A63F 3/0023 273/287
5,190,127 A * 3/1993 Cummings ..... B42F 13/40 190/102
5,271,649 A * 12/1993 Gromotka ..... E05C 19/14 292/DIG. 40
5,280,913 A * 1/1994 Sirk ..... A63F 3/0023 273/287
5,478,125 A * 12/1995 Gromotka ..... E05C 19/14 292/113
5,952,637 A * 9/1999 Strunk ..... A63F 3/0023 235/90
5,979,620 A * 11/1999 Lurie ..... A45C 9/00 248/166
6,257,631 B1 * 7/2001 Sokurenko ..... E05C 19/14 292/DIG. 49
6,322,485 B1 * 11/2001 Marrero ..... A63B 23/0211 482/142
6,457,750 B1 * 10/2002 Sokurenko ..... E05C 19/14 292/113
7,017,955 B1 * 3/2006 Chiang ..... E05C 19/14 292/113
7,237,776 B1 * 7/2007 Ngoto ..... A63F 3/02 273/285
D548,565 S * 8/2007 Vickers ..... D8/331
7,568,739 B2 * 8/2009 Lee ..... B25H 3/02 292/85
7,654,589 B2 * 2/2010 Vickers ..... E05B 13/002 292/DIG. 31
9,663,969 B2 * 5/2017 Lila ..... E05B 17/0058
10,309,134 B2 * 6/2019 Prehn ..... E05C 19/14
10,392,830 B2 * 8/2019 Helsley ..... E05B 27/0046
D889,932 S * 7/2020 Zeng ..... D8/331
D900,588 S * 11/2020 Rolfs ..... D8/331
D993,743 S * 8/2023 Zhou ..... D8/341
2002/0093138 A1 * 7/2002 Scovel ..... A63F 3/00176 273/288
2006/0119039 A1 * 6/2006 Reed ..... A63F 3/00895 273/236
2007/0102881 A1 * 5/2007 Holden ..... A63F 3/00895 273/260
2008/0012220 A1 * 1/2008 O'Neill ..... A63F 3/02 273/287
2008/0035505 A1 * 2/2008 Moore ..... B65D 21/022 206/315.1
2010/0032903 A1 * 2/2010 Wang ..... A63F 3/02 273/260
2012/0139296 A1 * 6/2012 Wilkens ..... E05C 19/14 296/193.11
2014/0265367 A1 * 9/2014 Lila ..... E05C 19/12 292/346

* cited by examiner

LOCKING MEMBER AND BOX THEREOF

CROSS-REFERENCE TO RELATED APPLICATION

This application is a continuation-in-art of U.S. patent application Ser. No. 18/434740, filed on Feb. 6, 2024, which claims priority to Chinese Patent Application No. 202321593475.7, titled "LOCK CATCH STRUCTURE AND STORAGE BOX OF CHESS PIECES" and filed to the China National Intellectual Property Administration on Jun. 20, 2023. This application claims priority to Chinese Application No. 202520482859.4 entitled "LOCKING MEMBER AND BOX THEREOF", filed on Mar. 18, 2025. The entire contents of which are incorporated herein by reference.

TECHNICAL FIELD

The present disclosure relates to the field of locksets, and especially relates to a locking member and a box thereof.

BACKGROUND

There are various types of locks which include mechanical locks that can be opened by using keys and lock cylinders, password locks by using password verification control to unlock the password locks, and buckles that only require manual locking or unlocking the buckles, rather than requiring keys or passwords input. This type of buckle is usually installed on other boxes that temporarily need to be locked, such as chess boxes. After the buckle is locked, it is only used to prevent other items received in a container from being fallen off. When needed, the buckle can be easily opened without a key or password to remove the items from the container.

A conventional chess box generally includes an upper cover and a lower cover rotatably connected with the upper cover. When the upper cover and the lower cover are fastened with each other, a receiving room is formed between the upper cover and the lower cover that are fastened, and configured to receive chess pieces therein. When fastening the upper cover and the lower cover, an upper fastener that is installed on the upper cover and a lower fastener that is installed on the lower cover are fastened to each other, thereby locking the upper cover and the lower cover. However, for the chess box, a special feature is that the back surfaces of both the upper cover and the lower cover, that is, chessboard marks are formed on sides of the upper cover and the lower cover that are arranged opposite to the receiving room. When the upper and lower covers are opened, to completely fold the upper and lower covers over, and the checkerboard marks located on the upper and lower covers are spliced together to form a complete checkerboard. The complete chessboard is configured to mark rules of playing chess. Users will use the chess pieces that are taken out of the receiving room to play on the chessboard. However, when the upper and lower covers are opened and folded, due to a fact that the upper and lower covers are connected, there will be a gap formed at connections between the upper and lower covers, or in other words, there is a certain angle between the upper and lower covers, which is not flat. In this way, an uneven chessboard obviously can't meet needs for being played.

Therefore, in the present disclosure, a technical problem to be solved is how to design a locking mechanism that is convenient for being locked and unlocked, and apply to the box; and when the box is opened, the locking mechanism can be configured to obtain a flat surface that the upper and lower covers are folded.

SUMMARY

The technical problems to be solved: in view of the shortcomings of the related art, an objective of the present disclosure is to provide a locking member.

A locking member according to an embodiment of the present disclosure includes:

a first locking component installed on one end of the box and including a first base and a fastener rotatably connected to the first base, a locking space provided on a side of the fastener that faces the first base; the fastener rotating relative to the first base from a second rotation position thereof so that the fastener rotates to move close to or move away from the first base, for achieving a lock or an unlock thereof;

a second locking component including a second base and a deformable locking portion mounted on the second base, wherein the locking portion is arranged on a first surface of the second base that is away from the first base, and the second base is assembled on the other end of the box; and wherein a second surface of the first base that faces the second base is provided with a first protrusion and a first receiving portion; a third surface of the second base that faces the first base is provided with a second protrusion and a second receiving portion; and wherein when the locking member is locked, the first base and the second base are opposite to each other, and the first protrusion is located in the second receiving portion, the second protrusion is located in the first receiving portion, and the first base and the second base are synchronously embedded into the locking space; and wherein the locking portion is pressed against an inner wall of the locking space when the locking member is locked, so as to engage with fastener and prevent the first base and the second base from detaching from each other; and wherein when the fastener rotates away from the second base, the second base disengages from the first base for causing the locking member to be unlocked; and wherein when the locking member is unlocked, both the first protrusion and the second protrusion are served as support feet for supporting the box.

A box according to an embodiment of the present disclosure includes:

an upper cover and a lower cover rotatably connected with the upper cover so as to open and close the box; and wherein when the box is closed, contact surfaces between the upper cover and the lower cover are end surfaces, and surfaces of the upper cover and the lower cover that are relative to a first rotation position thereof are vertical surfaces;

two locking members that each of the two locking members comprises a first locking component and a second locking component opposite to each other, wherein the first locking component is installed on the vertical surface of the upper cover and the second locking component is installed on the vertical surface of the lower cover; and wherein when the locking member is unlocked, both the first protrusion and the second protrusion protrude from the end surfaces, and are served as support feet for supporting the box.

The locking member and the box thereof of the present disclosure are provided that the locking member is easily configured to insert the first base into the second base through the first protrusion and the second protrusion thereof, and use the fastener to simultaneously receive and lock the first base and the second base in the locking space of the fastener for obtaining a lock thereof; when the fastener is subjected to a force to rotate away from the second base, the second base detaches from the first base for achieving an unlock thereof; when the first base and the second base are respectively installed near two end surfaces of the box that need to be locked, after the box is opened, the first and second protrusions are configured to be as support feet for the box, thereby ensuring flatness of splicing surfaces of the box after folding the box as much as possible. The locking member of the present disclosure is simple and easy to be operated, and the box is beautiful and saving costs.

The element labels according to the embodiment of the present disclosure shown as below:

100 box, 11 upper cover, 12 lower cover, 13 receiving room, 14 end surface, 15 vertical surface, 200 locking member, 21 first locking component, 210 first base, 211 fastener, 212 locking space, 213 first seat, 214 first mounting hole, 215 perforation, 216 rotating hole, 217 locking hole, 22 second locking component, 220 second base, 221 locking portion, 222 second seat, 223 second mounting hole, a1 first protrusion, a2 second protrusion, b1 first receiving portion, b2 second receiving portion, c rotating shaft, M1 first surface, M2 second surface, M3 third surface, M4 inner wall, p1, p2 two ends, N1 first rotation position, N2 second rotation position.

DETAILED DESCRIPTION

Reference will now be made in detail to embodiments, examples of which are illustrated in the accompanying drawings.

Figure 1:
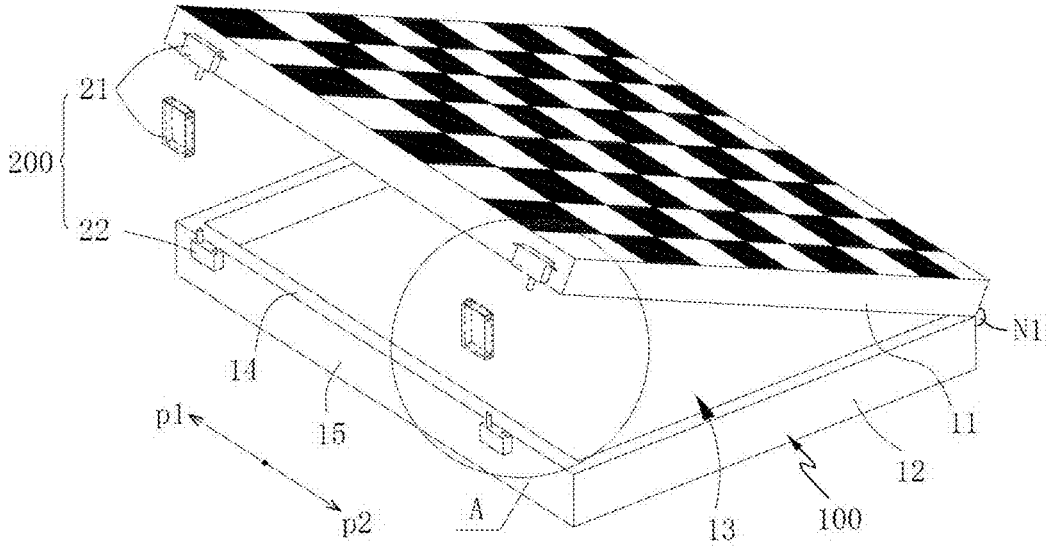
FIG. 1 is a schematic view of a box in accordance with an embodiment of the present disclosure.
Figure 2:
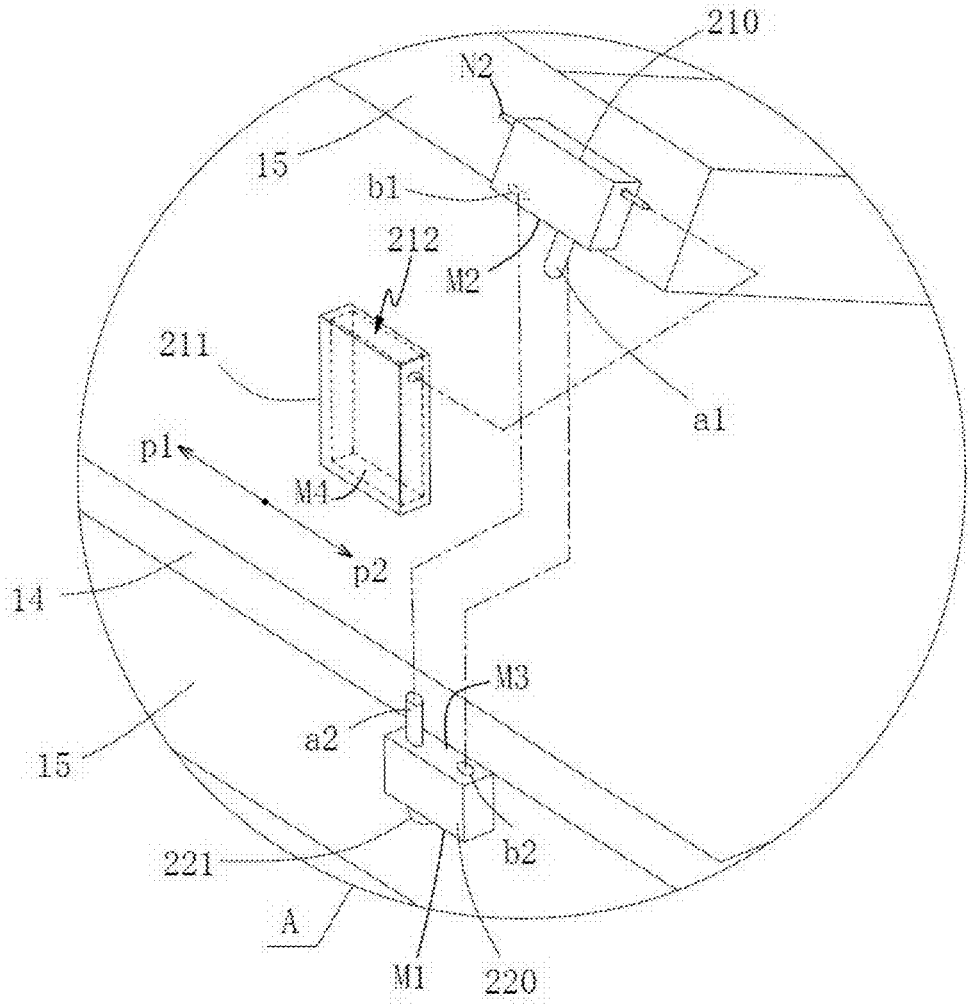
FIG. 2 is a partial enlarged view of FIG. 1.

Referring to FIG. 1 and FIG. 2, a box 100 according to an embodiment of the present disclosure includes an upper cover 11, and a lower cover 12 rotatably connected with the upper cover 11 so as to open and close the box 100. The box 100 is exemplified as a chess box.

When the upper cover 11 is completely closed on the lower cover 12, a sealed receiving room 13 is formed between the upper cover 11 and the lower cover 12, which is configured to accommodate items therein. When the box 100 is closed, contact surfaces between the upper cover 11 and the lower cover 12 are end surfaces 14, and surfaces of the upper cover 11 and the lower cover 12 that are relative to a first rotation position N1 are vertical surfaces 15. When the box 100 is opened and flipped, outer surfaces of the upper cover 11 and the lower cover 12 are folded and combined together to form a relatively flat surface thereof. Patterns or lines that are set on the outer surfaces of the upper cover 11 and the lower cover 12 can be used as a chessboard for being played.

When the upper cover 11 and the lower cover 12 are folded, the end surfaces 14 of the upper cover 11 and the lower cover 12 are placed downwards, which can be placed on a desktop or the ground.

The box 100 includes two locking members 200, the two locking members 200 respectively arranged near two ends p1, p2 thereof along a width direction of the box 100.

The two locking members 200 distribution on the two ends p1, p2 of the box 100 in pairs. Each locking member 200 includes: a first locking component 21 and a second locking component 22 opposite to each other, wherein the first locking component 21 is installed on the vertical surface 15 of the upper cover 11, while the second locking component 22 is installed on the vertical surface 15 of the lower cover 12.

Figure 3:
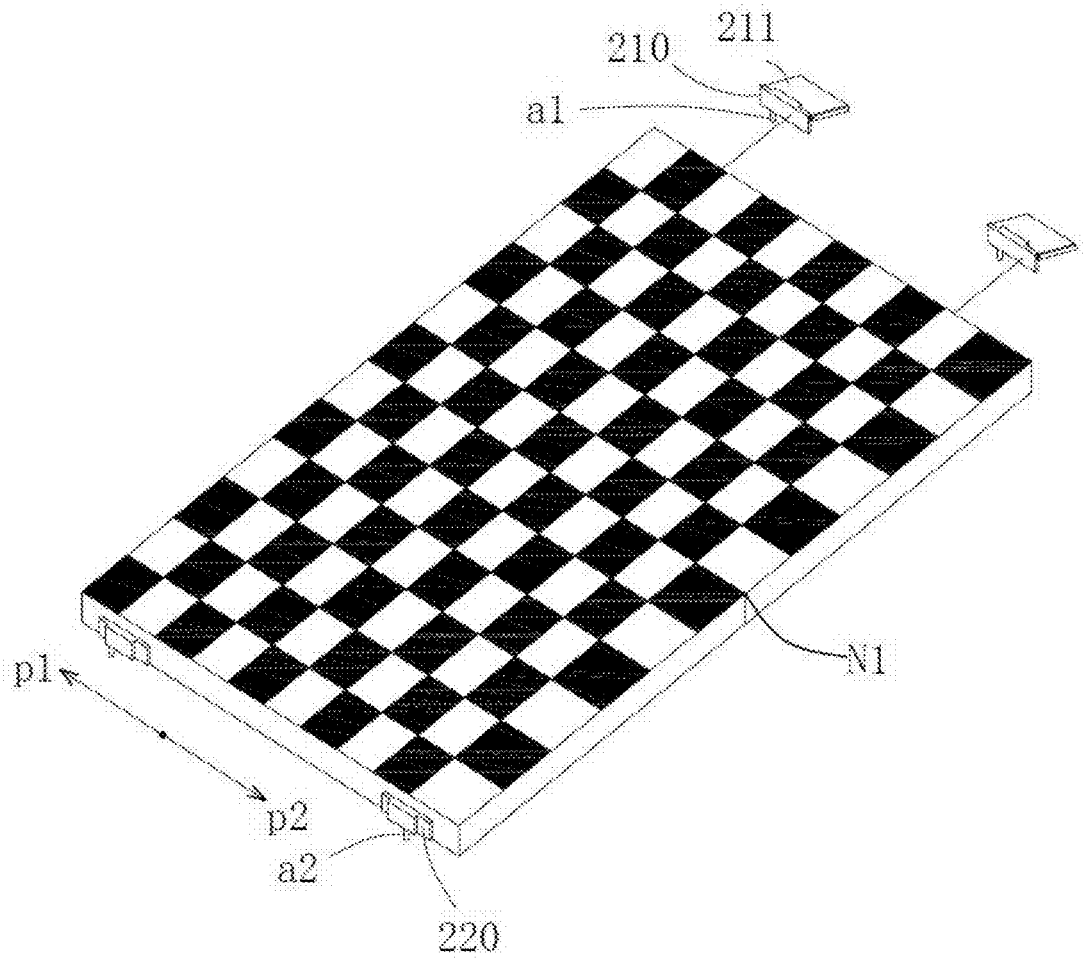
FIG. 3 is a schematic view of the box of FIG. 1, but shown the box is opened.
Figure 4:
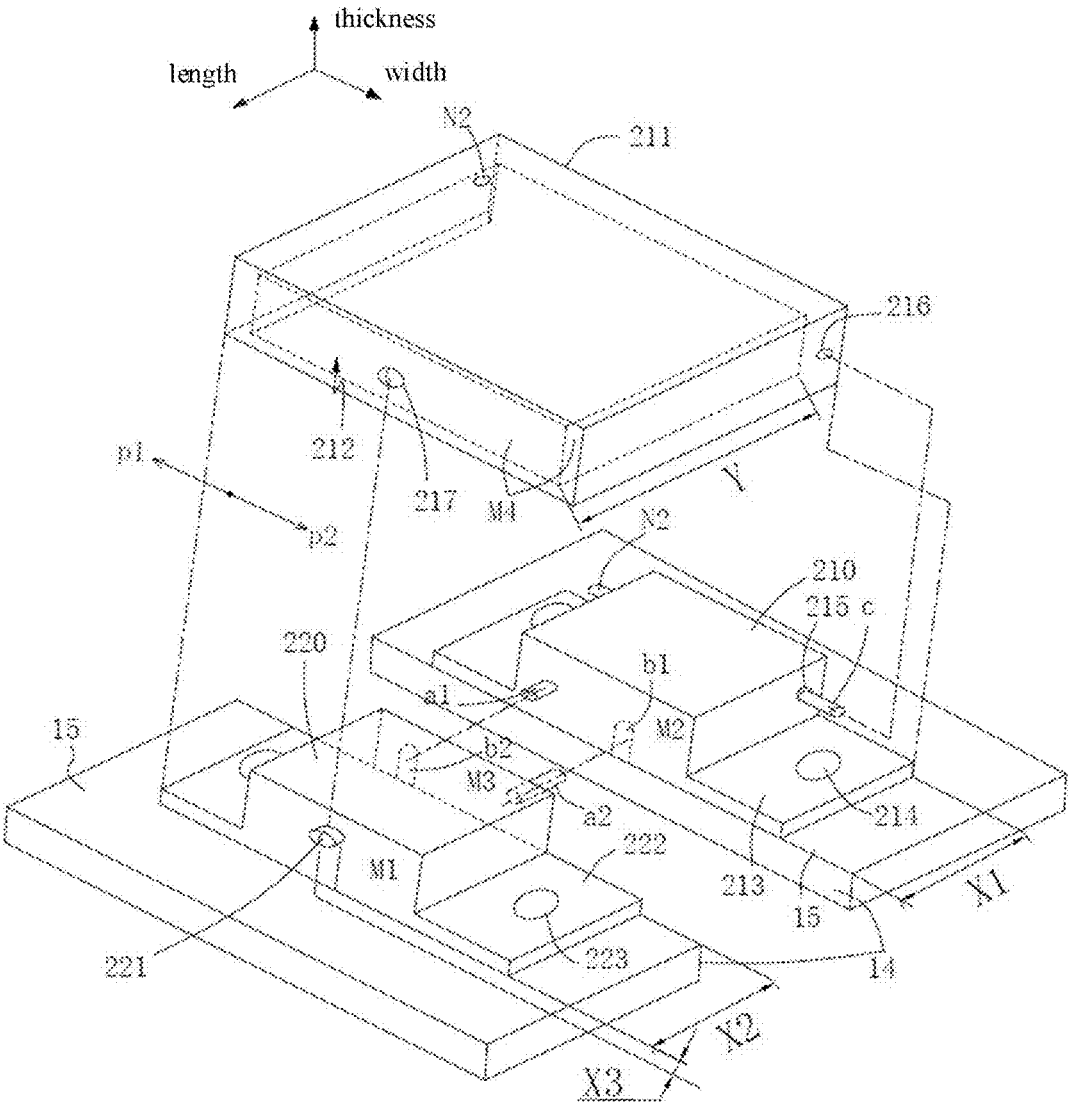
FIG. 4 is an exploded, schematic view of a locking member of the box of FIG. 1.

Referring to FIG. 2 to FIG. 4, the first locking component 21 includes a first base 210 and a fastener 211 rotatably connected to the first base 210, a locking space 212 provided on a side of the fastener 211 that faces the first base 210, the fastener 211 rotating relative to the first base 210 from a rotation position N2 thereof so that the fastener 211 rotates to move close to or move away from the first base 210, for achieving a lock or an unlock thereof. The first base 210 is mounted on the vertical surface 15.

The second locking component 22 includes a second base 220 and a deformable locking portion 221 mounted on the second base 220, wherein the locking portion 221 is arranged on a first surface M1 of the second base 220 that is away from the first base 210.

A second surface M2 of the first base 210 that faces the second base 220 is provided with a first protrusion a1 and a first receiving portion b1, while, a third surface M3 of the second base 220 that faces the first base 210 is provided with a second protrusion a2 and a second receiving portion b2.

When both the upper cover 11 and the lower cover 12 are closed and the locking member 200 is locked, the first base 210 and the second base 220 are opposite to each other, the first protrusion a1 is located in the second receiving portion b2, the second protrusion a2 is located in the first receiving portion b1, and the first base 210 and the second base 220 are synchronously embedded into the locking space 212. The locking portion 221 is pressed against an inner wall M4 of the locking space 212 when the locking member 221 is locked, so as to engage with the fastener 211 and prevent the first base 210 and the second base 220 from detaching from each other.

When the fastener 211 rotates away from the second base 220, the second base 220 disengages from the first base 210 for causing the locking member 200 to be unlocked.

Referring to FIG. 3, when the locking member 200 is in an unlocked state, the box 100 is folded to form a relatively flat plane, and the upper cover 11 and the lower cover 12 are combined to form the chessboard, both the first protrusion a1 and the second protrusion a2 protrude from the end surface 14 to serve as support feet for supporting on the desktop or the ground, so as to support the box 100. At this time, the first protrusion a1 and the second protrusion a2 are in the same plane, and the upper cover 11 and the lower cover 12 will be pressed downwards at the first rotation position N1 due to a gravity thereof, thereby forming the flat plane without gaps and making appearances more beautiful.

Referring to FIG. 2 and FIG. 3, when the two locking members 200 that are arranged on two ends of the box 100 are opened, two first protrusions a1 and two second protrusions a2 are formed, which is a total of four support feet. At this time, the two first protrusions a1 and the two second protrusions a2 are cooperatively to form four vertices of a quadrilateral, result in making the box 100 be more firmly fixed.

Referring to FIG. 2 and FIG. 4, the first protrusion a1 is opposite to the second receiving portion b2, and the second protrusion a2 is opposite to the first receiving portion b1. A length of the first protrusion a1 is the same as that of the second protrusion a2. The first and second protrusions a1, a2 with the same length can be served as support feet to prevent the box 100 from being tilted.

A size of the first receiving portion b1 is greater than that of the second protrusion a2, and a size of the second receiving portion b2 is greater than that of the first protrusion a1. In the present disclosure, only when the first base 210 and the second base 220 are aligned with each other in the length direction thereof and inserted with each other, both the first base 210 and the second base 220 can be simultaneously received in the locking space 212 that are inside the fastener 211 by rotating the fastener 211, thereby locking the box 100. Therefore, when the size of the first receiving portion b1 is larger than that of the second protrusion a2, it can conveniently engage the first base 210 with the second base 220, so that there will be no issues that inaccurate alignment and insertion are occurred due to small differences of the sizes therebetween. The difference of the sizes between the first receiving portion b1 and the second protrusion a2 only needs to be ensured that the first base 210 and the second base 220 can't be separated in a thickness direction and a width direction thereof, when the fastener 211 is locked. When the box 100 is made of a hard material, and both the first base 210 and the second base 220 are installed on the hard material, neither the first base 210 nor the second base 220 can move in the thickness direction thereof. Therefore, at this time, the sizes of the first receiving portion b1 and the second protrusion a2 that are easy to be engaged with each other only need to ensure that the first receiving portion b1 and the second protrusion a2 are not separated from each other in the width direction thereof.

Each of the first protrusion a1 and the second protrusion a2 is a cylindrical nail, and each of the first receiving portion b1 and the second receiving portion b2 is a receiving hole. In this way, in the present disclosure, a purpose of using the nails and the holes for aligning and positioning with each other is achieved. The first base 210 and the second base 220 are inserted with each other, especially when the receiving hole is a slot hole, which can further facilitate an insertion of the first base 210 and the second base 220. As shown in FIG. 4, FIG. 4 is an exploded, schematic view of the disassembly of the locking member 200 of the present disclosure.

The first locking component 21, in addition to include the first base 210, also includes a first seat 213. The first base 210 is mounted on the vertical surface 15 through the first seat 213.

In the present disclosure, a width of the first seat 213 is greater than that of the first base 210, that is, the first seat 213 protrudes outwardly from the first base 210. One method is: the first seat 213 is integral with the first base 210 and extends outwardly from the first base 210. A thickness of the first base 213 is smaller than that of the first base 210. A first mounting hole 214 is provided on the first base 213, and the first base 213 is fixed to the vertical surface 15 through the first mounting hole 214, thereby fixing the first base 210 to the box 100.

The locking portion 221 is elastic and protrudes from the first surface M1 of the second base 220.

Similarly, the second locking component 22 also includes a second seat 222, and the second base 220 is mounted on the vertical surface 15 through the second seat 222. A width of the second seat 222 is greater than that of the second base 220, that is, the second seat 222 protrudes from the second base 220. One method is: the second seat 222 is integral with the second base 220 and extends outwardly from the second base 220. A thickness of the second base 222 is smaller than that of the second base 220. A second mounting hole 223 is provided on the second base 220, and the second base 220 is fixed to the vertical surface 15 through the second mounting hole 223, thereby fixing the second base 220 to the box 100.

In the present disclosure, the width of the first seat 231 is equal to the width of the second seat 222. At the same time, each of the width of the first seat 213 and the width of the second seat 222 is equal to a width of the fastener 211, so that the fastener 211 covers on both the first base 210 and the first seat 213, and covers on both the second base 220 and the second seat 222. At this time, when the fastener 211 is locked, the fastener 211 completely seals the first seat 213 and the second seat 222, and even simultaneously accommodates the first base 210 and the second base 220 within the locking space 212. Neither of the width of the first base 210 and the width of the second base 220 is greater than a width of the locking space 212, so that both the first and second bases 210, 220 can be received in the locking space 212.

Specifically, the width of the first base 210 and the width of the second base 220 are equal to the width of the locking space 212. At this point, both the first base 210 and the second base 220 are securely fixed within the locking space 212, result in preventing the first base 210 and the second base 220 from shaking within the locking space 212 along the width direction thereof.

In the present disclosure, when the first base 210 and the fastener 211 are rotatably connected with each other, a shaking gap is formed therebetween. That is to say, when the fastener 211 rotates relative to the first base 210 or the second base 220 for locking the box 100, a structure that is composed of the first base 210 and the second base 220 can shake relative to the fastener 211 within a small range, thereby adjusting an angle and a distance that the first base 210 and the second base 220 are accommodated into the locking space 212, which can avoid a problem that the second base 220 is difficult to be received into the locking space 212 is occurred. The farthest range of shaking is less than the maximum length of the locking portion 221.

In an embodiment of the present disclosure, a length of the first base 210 is set to 1.8 cm, while a length of the second base 220 is the same as that of the first base 210. However, a length of the locking portion 221 that protrudes from the surface of the second base 220 is set to 2.1 mm, in this way, after the first base 210 and the second base 220 are engaged with each other, a total length is 1.81 cm, which is 1.8+1.8+0.21=3.81 cm. The length of the locking space 212 that is set at this time for accommodating the first base 210 and the second base 220 is 3.60 cm. When the first base 210 and the second base 220 are engaged with each other, during a rotation of the fastener 211 relative to the first base 210, an inner wall of the fastener 211, that is, the inner wall M4 of the locking space 212, comes into contact with the locking portion 221. During in the fastening process, the first base 210 and the second base 220 shake relative to a second rotation position N2 thereof that the fastener 211 rotates can reduce a clearance that the locking portion 221 is beyond the inner wall of the fastener 211. Under an action of an external force, the fastener 211 is pressed down, and the external force can cause the second base 220 and the locking portion 221 to be compressed into the locking space 212. At this time, the deformable locking portion 221 undergoes deformation towards the locking space 212 when the locking portion 221 is pressed into the locking space 212. After the locking portion 221 is completely pressed into the locking space 212, the locking portion 221 recovers its deformation and presses against the inner wall of the fastener 211.

In the present disclosure, the shaking gap can be selected between 1.8 mm-2.1 mm, which is preferred to be 2 mm. When the shaking gap is 2 mm, the clearance that the locking portion 221 is beyond the inner wall of the fastener 211 is reduced to 0.1 mm without the external force, which can conveniently and quickly lock the locking portion 211, and lock the second base 220 within the locking space 212 after the locking is done.

From another perspective, the length X3 of the locking portion 221 is greater than 2 mm, which means that even if the second base 220 with the maximum rotation radius rotates the fastener 211 for locking the fastener 211, it can still ensure that the inner wall of the locking space 212 contacts the locking portion 221 to compress and fix the second base 220 by the deformation of the locking portion 221, thereby preventing that the fastener 211 detaches from the second base 220, and avoiding an occurrence of accidental unlocking from being occurred without the external force thereof.

A pair of perforations 215 is arranged on the two ends p1, p2 of the first base 210 along a width direction of the first base 210, and a pair of rotating holes 216 is arranged on the inner wall M4 of the fastener 211 that is within the locking space 212, a rotating shaft c passing through the pair of perforations 215 and then fixedly installed in the pair of rotating holes 216, and the fastener 211 rotating relative to the first base 210 with the rotating shaft c. In the present disclosure, during the rotation of the fastener 211, a central rotation axis, which is also known as the rotating shaft c, can shake within the pair of perforations 215, thereby changing a rotation radius thereof during the rotation process, which allows the inner wall M4 of the locking space 212 that is away from the rotating shaft c can come into contact with an installation surface where the locking portion 221 is located, that is in contact with the first surface M1, so that a distal end of the second base 220 is first received into the locking space 212. And then, the fastener 211 continues to be pressed down, and at this time, the inner wall M4 of the locking space 212 that is far away from the rotating shaft c comes into contact with the locking portion 221. The locking portion 221 deforms under an action of the fastener 211 until the locking portion 221 and the second base 220 are completely received in the locking space 212. At this point, a complete locking is obtained.

A locking hole 217 is arranged on the inner wall M4 of the locking space 212, and opposite to the first base 210, the locking hole 217 configured to receive the locking portion 221 therein during the locking hole 217 in a locked state. The locking portion 221 is an elastic nail. After the locking portion 221 is limited and fixed in the locking hole 217, it can use the deformation of the locking portion 221 to press the first base 210 and the second base 220, so as to prevent shaking thereof as much as possible. In addition, the locking hole 217 can also serve as a fixed point to position and fix the second base 220 to a certain extent within the locking space 212, thereby further reducing a shaking that is occurred between the first base 210 and the second base 220. In the present disclosure, the length of the locking space 212 is taken as Y, the length of the first base 210 is taken as X1, the length of the second base 220 is taken as X2, and the length of the locking portion 221 that protrudes from the surface of the second base 220 is taken as X3, wherein $X1+X2+X3>Y\geq X1+X2$.

Although the features and elements of the present disclosure are described as embodiments in particular combinations, each feature or element can be used alone or in other various combinations within the principles of the present disclosure to the full extent indicated by the broad general meaning of the terms in which the appended claims are expressed. Any variation or replacement made by one of ordinary skill in the related art without departing from the spirit of the present disclosure shall fall within the protection scope of the present disclosure.

What is claimed is:

1. A locking member comprising:

a first locking component configured to be installed on one end of a box and comprising a first base and a fastener rotatably connected to the first base, a locking space provided on a side of the fastener that faces the first base; the fastener rotating relative to the first base from a rotation position thereof so that the fastener rotates to move close to or move away from the first base, for achieving a lock or an unlock thereof;

a second locking component comprising a second base and a deformable locking portion mounted on the second base, wherein the deformable locking portion is arranged on a first surface of the second base that is away from the first base, and the second base is configured to be assembled on the other end of the box; and wherein a second surface of the first base that faces the second base is provided with a first protrusion and a first receiving portion; a third surface of the second base that faces the first base is provided with a second protrusion and a second receiving portion; and wherein when the locking member is locked, the first base and the second base are opposite to each other, and the first protrusion is located in the second receiving portion, the second protrusion is located in the first receiving portion, and the first base and the second base are synchronously embedded into the locking space; and wherein the deformable locking portion is pressed against an inner wall of the locking space when the locking member is locked, so as to engage with the fastener and prevent the first base and the second base from detaching from each other; and wherein when the fastener rotates away from the second base, the second base disengages from the first base for causing the locking member to be unlocked; and wherein when the locking member is unlocked, both the first protrusion and the second protrusion are served as support feet that are configured to support the box.

2. The locking member as claimed in claim 1, wherein the first locking component further comprises a first seat, and the second locking component comprises a second seat; the first base is configured to be installed on the box through the first seat, the second base is configured to be installed on the box through the second seat; a width of the first seat is greater than that of the first base, a width of the second seat is greater than that of the second base, and the width of the first seat is equal to the width of the second seat.

3. The locking member as claimed in claim 2, wherein each of the width of the first seat and the width of the second seat is equal to a width of the fastener, so that the fastener covers on both the first base and the first seat, and covers on both the second base and the second seat, when the fastener is locked;

and wherein neither of the width of the first base and the width of the second base is greater than a width of the locking space.

4. The locking member as claimed in claim 3, wherein the first seat is integral with the first base, and the second seat is integral with the second base, the first seat comprising first mounting holes, the second seat comprising second mounting holes, the first seat is configured to be fixed to the box through the first mounting holes, and the second seat is configured to be fixed to the box through the second mounting holes.

5. The locking member as claimed in claim 1, wherein the first base and the fastener are rotatably connected with each other so that a shaking gap is formed therebetween.

6. The locking member as claimed in claim 5, wherein a pair of perforations is arranged on two ends of the first base along a width direction of the first base, and a pair of rotating holes is arranged on an inner wall of the fastener that is within the locking space, a rotating shaft passing through the pair of perforations and then fixedly installed in the pair of rotating holes, and the fastener rotating relative to the first base with the rotating shaft; and wherein an aperture of the pair of perforations is larger than that of the rotating shaft.

7. The locking member as claimed in claim 1, wherein the first protrusion is opposite to the second receiving portion, and the second protrusion is opposite to the first receiving portion; and wherein a length of the first protrusion is the same as that of the second protrusion, a size of the first receiving portion is greater than that of the second protrusion, and a size of the second receiving portion is greater than that of the first protrusion.

8. The locking member as claimed in claim 7, wherein each of the first protrusion and the second protrusion is a cylindrical nail, and each of the first receiving portion and the second receiving portion is a receiving hole.

9. The locking member as claimed in claim 8, wherein the receiving hole is a slot hole.

10. The locking member as claimed in claim 1, wherein the deformable locking portion is elastic and protrudes from the first surface of the second base.

11. The locking member as claimed in claim 10, wherein a length of the locking space is taken as Y, a length of the first base taken as X1, a length of the second base taken as X2, and a length of the locking portion that protrudes from the first surface of the second base taken as X3, wherein $X1+X2+X3>Y\geq X1+X2$.

12. The locking member as claimed in claim 11, wherein a locking hole is arranged on an inner wall of the locking space, and opposite to the first base, the locking hole configured to receive the deformable locking portion therein during the locking hole in a locked state; and wherein the deformable locking portion is an elastic nail.

13. A box comprising:

an upper cover and a lower cover rotatably connected with the upper cover so as to open and close the box; and wherein when the box is closed, contact surfaces between the upper cover and the lower cover are end surfaces, and surfaces of the upper cover and the lower cover that are relative to a first rotation position thereof are vertical surfaces;

two locking members that each of the two locking members comprises a first locking component and a second locking component opposite to each other, wherein the first locking component is installed on the vertical surface of the upper cover and the second locking component is installed on the vertical surface of the lower cover; and wherein the first locking component comprises a first base and a fastener rotatably connected to the first base, a locking space provided on a side of the fastener that faces the first base; the fastener rotating relative to the first base from a second rotation position thereof so that the fastener rotates to move close to or move away from the first base, for achieving a lock or an unlock thereof; and wherein the second locking component comprises a second base and a deformable locking portion mounted on the second base, wherein the deformable locking portion is arranged on a first surface of the second base that is away from the first base; and wherein a second surface of the first base that faces the second base is provided with a first protrusion and a first receiving portion; a third surface of the second base that faces the first base is provided with a second protrusion and a second receiving portion; and wherein when both the upper cover and the lower cover are closed and the locking member is locked, the first base and the second base are opposite to each other, and the first protrusion is located in the second receiving portion, the second protrusion located in the first receiving portion, and the first base and the second base synchronously embedded into the locking space; and wherein the deformable locking portion is pressed against an inner wall of the fastener in the locking space when the locking member is locked, so as to engage with the fastener and prevent the first base and the second base from detaching from each other; and wherein when the fastener rotates away from the second base, the second base disengages from the first base causing the locking member to be unlocked; and wherein when the locking member is unlocked, both the first protrusion and the second protrusion protrude from the end surface, and are served as support feet for supporting the box.

14. The box as claimed in claim 13, wherein the at least two locking members are two locking members and arranged on two ends of the box respectively; when the upper cover and the lower cover are opened, the first protrusion and the second protrusion of the two locking members form four vertices of a rectangle.

15. The box as claimed in claim 13, wherein the first locking component further comprises a first seat, and the second locking component comprises a second seat; the first base installed on the vertical surface through the first seat, the second base installed on the vertical surface through the second seat; a width of the first seat is greater than that of the first base, a width of the second seat is greater than that of the second base, and the width of the first seat is equal to the width of the second seat; and wherein each of the width of the first seat and the width of the second seat is equal to a width of the fastener, so that the fastener covers on both the first base and the first seat, and covers on both the second base and the second seat, when the fastener is locked; and wherein neither of the width of the first base and the width of the second base is greater than a width of the locking space.

16. The box as claimed in claim 15, wherein the first seat is integral with the first base, and the second seat is integral with the second base, the first seat comprising first mounting holes, the second seat comprising second mounting holes, the first seat fixed to the vertical surface through the first mounting holes, and the second seat fixed to the vertical surface through the second mounting holes; and wherein the first base and the fastener are rotatably connected with each other so that a shaking gap is formed therebetween.

17. The box as claimed in claim 13, wherein a pair of perforations is arranged on two ends of the first base along a width direction of the first base, and a pair of rotating holes is arranged on the inner wall of the fastener that is within the locking space, a rotating shaft passing through the pair of perforations and then fixedly installed in the pair of rotating holes, and the fastener rotating relative to the first base with the rotating shaft; and wherein an aperture of the pair of perforations is larger than that of the rotating shaft.

18. The box as claimed in claim 13, wherein the first protrusion is opposite to the second receiving portion, and the second protrusion is opposite to the first receiving portion; and wherein a length of the first protrusion is the same as that of the second protrusion, a size of the first receiving portion greater than that of the second protrusion, and a size of the second receiving portion greater than that of the first protrusion.

19. The box as claimed in claim 13, wherein a length of the locking space is taken as Y, a length of the first base taken as X1, a length of the second base taken as X2, and a length of the locking portion that protrudes from the surface of the second base taken as X3, wherein $X1+X2+X3>Y\geq X1+X2$.

20. The box as claimed in claim 13, wherein a locking hole is arranged on the inner wall of the locking space, and opposite to the first base, the locking hole configured to receive the deformable locking portion therein during the locking hole in a locked state; and wherein the deformable locking portion is an elastic nail.

* * * * *